US011295889B2

(12) United States Patent
Xu et al.

(10) Patent No.: US 11,295,889 B2
(45) Date of Patent: Apr. 5, 2022

(54) PULLING PLATE STRUCTURE FOR A THREE-DIMENSIONAL WOUND CORE OF TRANSFORMER

(71) Applicant: Haihong Electric Co., LTD., Guangdong (CN)

(72) Inventors: Kaixuan Xu, Guangdong (CN); Lizhen Zhai, Guangdong (CN); Qingning Liang, Guangdong (CN); Jingtao Luo, Guangdong (CN); Libo Zhou, Guangdong (CN)

(73) Assignee: Haihong Electric Co., LTD., Guangdong (CN)

( * ) Notice: Subject to any disclaimer, the term of this patent is extended or adjusted under 35 U.S.C. 154(b) by 411 days.

(21) Appl. No.: 16/465,587

(22) PCT Filed: Nov. 24, 2017

(86) PCT No.: PCT/CN2017/112731

§ 371 (c)(1),
(2) Date: May 31, 2019

(87) PCT Pub. No.: WO2018/176867

PCT Pub. Date: Oct. 4, 2018

(65) Prior Publication Data

US 2020/0020476 A1 Jan. 16, 2020

(30) Foreign Application Priority Data

Apr. 1, 2017 (CN) ..... 201720347345.3

(51) Int. Cl.
*H01F 27/26* (2006.01)
*H01F 27/245* (2006.01)

(52) U.S. Cl.
CPC ..... *H01F 27/263* (2013.01); *H01F 27/245* (2013.01)

(58) Field of Classification Search
CPC ..... H01F 27/263; H01F 27/245; H01F 27/26; H01F 27/25
See application file for complete search history.

(56) References Cited

FOREIGN PATENT DOCUMENTS

CN 201204118 Y 3/2009
CN 203760270 U 8/2014
(Continued)

OTHER PUBLICATIONS

International Search Report and Written Opinion dated Dec. 27, 2017, for corresponding International Application Mo: PCT/CN2017/112731; International Filing Date: Nov. 24, 2017 consisting of 6-pages.

*Primary Examiner* — Tuyen T Nguyen
(74) *Attorney, Agent, or Firm* — Christopher & Weisberg, P.A.

(57) ABSTRACT

A novel pulling plate structure for a three-dimensional wound core of a transformer, including a three-dimensional wound core spliced by three rectangular single frames, the three-dimensional wound core includes three core legs, an upper iron yoke and a lower iron yoke, an upper frame surrounding the upper iron yoke is installed in a top of the three-dimensional wound core, a lower frame surrounding the upper iron yoke is installed at a bottom of the three-dimensional wound core, the core leg has a longitudinal cross-section opposite and parallel to inside faces of the upper frame and the lower frame, a pulling plate is installed in a plane of the longitudinal cross-section, the pulling plate is connected with the upper frame and the lower frame.

5 Claims, 2 Drawing Sheets

(56) References Cited

FOREIGN PATENT DOCUMENTS

| | | | | |
|---|---|---|---|---|
| CN | 203910455 | U | | 10/2014 |
| CN | 204117781 | U | | 1/2015 |
| CN | 105575622 | A | * | 5/2016 |
| CN | 205428654 | U | * | 8/2016 |

* cited by examiner

PULLING PLATE STRUCTURE FOR A THREE-DIMENSIONAL WOUND CORE OF TRANSFORMER

CROSS-REFERENCE TO RELATED APPLICATIONS

This application is a Submission under 35 U.S.C. § 371 for U.S. National Stage Patent Application of International Application Number PCT/CN2017/112731, filed Nov. 24, 2017, entitled NOVEL THREE-DIMENSIONAL WOUND CORE PULL PLATE STRUCTURE FOR TRANSFORMER, which claims priority to Chinese Application No. 201720347345.3, filed Apr. 1, 2017, the entirety of both of which are incorporated herein by reference.

CROSS-REFERENCE TO RELATED APPLICATION

N/A

FIELD

The disclosure relates to the field of transformer technologies, and more particularly, to a pulling plate structure for a three-dimensional wound core of a transformer.

BACKGROUND

At present, advantages of a transformer product with a three-dimensional wound core have been affirmed by the vast number of users, and market share and product capacity thereof are increasing. However, a pulling screw or a mixed structure of the pulling screw and a pulling plate is used in a three-dimensional wound core and a winding compression structure of a traditional transformer, while compression forces of the two structures are relatively small, and the pulling screw requires insulation between windings and leads, which increases a size and a manufacturing difficulty of a transformer oil tank, and also increases manufacturing costs.

SUMMARY

In order to overcome the defects of the prior art, the disclosure is intended to provide a pulling plate structure for a three-dimensional wound core of a transformer, which can reduce costs and improve a safety of the transformer.

The technical solution used to solve the technical problem in the disclosure is as follows.

A novel pulling plate structure for a three-dimensional wound core of a transformer comprises a three-dimensional wound core spliced by three rectangular single frames, the three-dimensional wound core comprises three core legs, an upper iron yoke and a lower iron yoke, an upper frame surrounding the upper iron yoke is installed in a top of the three-dimensional wound core, a lower frame surrounding the upper iron yoke is installed in a bottom of the three-dimensional wound core, the core leg has a longitudinal cross-section opposite and parallel to inside faces of the upper frame and the lower frame, a pulling plate is installed in a plane of the longitudinal cross-section, and the pulling plate is connected with the upper frame and the lower frame.

Further, the upper frame and the lower frame are provided with positioning holes, and a connecting shaft for being fixedly connected with the pulling plate is installed in the positioning hole.

Further, the rectangular single frame is continuously wound by a plurality of whole silicon steel sheets or amorphous alloy strips.

Further, the upper frame and the lower frame comprise a chamfered triangular frame and a Y-shaped holder connected with an inside of the triangular frame.

The disclosure has the beneficial effects that: the pulling plate structure for the three-dimensional wound core used in the disclosure meets short-circuit force requirements of different transformers by changing cross-section sizes of the pulling plate and the connecting shaft, the design scheme is simplified, and the manufacturing process is simple; since the pulling plate is arranged in a circle of the cross-section of the core, an isolation distance among a winding, a lead and the pulling plate can be ignored, thus reducing an overall size of the transformer and saving a total cost of the transformer by 3% to 5%; and discharge points of the winding and the lead to ground are reduced, thus optimizing a structure, reducing costs, and improving a productivity and an operation safety of the transformer.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

The disclosure is further described below with reference to the drawings and the embodiments.

Figure 1:
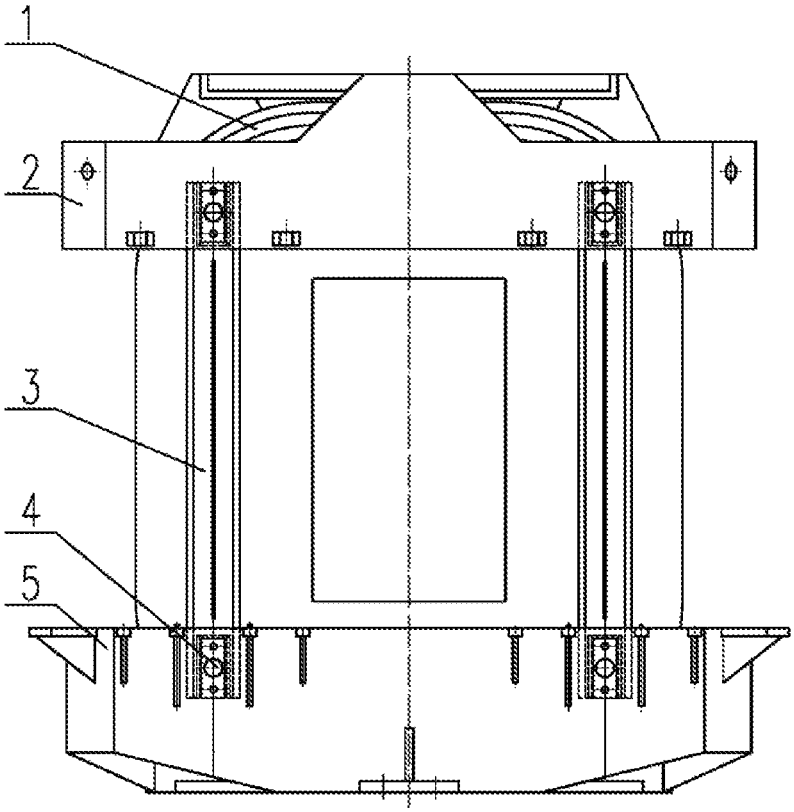
FIG. 1 is a front view of the disclosure.
Figure 2:
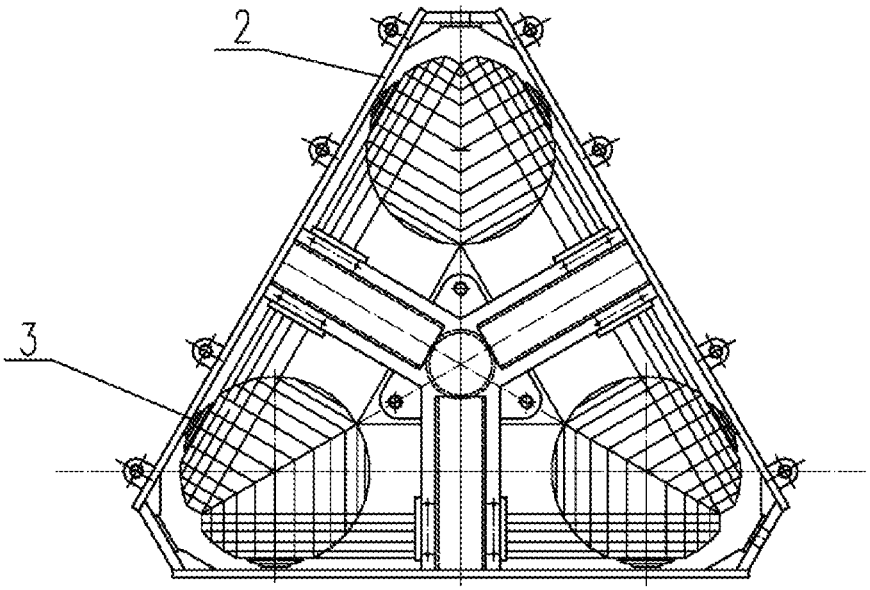
FIG. 2 is a top view of the disclosure.

As shown in FIG. 1 and FIG. 2, a novel pulling plate structure for a three-dimensional wound core of a transformer according to the disclosure comprises a three-dimensional wound core 1 spliced by three rectangular single frames, wherein the three-dimensional wound core 1 comprises three core legs, an upper iron yoke and a lower iron yoke, an upper frame 2 surrounding the upper iron yoke is installed in a top of the three-dimensional wound core 1, a lower frame 5 surrounding the upper iron yoke is installed in a bottom of the three-dimensional wound core 1, the core leg has a longitudinal cross-section opposite and parallel to inside faces of the upper frame 2 and the lower frame 5, a pulling plate 3 is installed in a plane of the longitudinal cross-section, and the pulling plate 3 is connected with the upper frame 2 and the lower frame 5.

The upper frame 2 and the lower frame 5 are provided with positioning holes, and a connecting shaft 4 for being fixedly connected with the pulling plate 3 is installed in the positioning hole, so that the pulling plate 3 is fixedly connected with the upper frame 2 and the lower frame 5.

The rectangular single frame is continuously wound by a plurality of whole silicon steel sheets or amorphous alloy strips.

The upper frame 2 and the lower frame 5 comprise a chamfered triangular frame and a Y-shaped holder connected with an inside of the triangular frame, and the upper frame 2 and the lower frame 5 are respectively installed in the top and the bottom of the three-dimensional wound core.

According to the disclosure, by adjusting a width of a core piece, the pulling plate meeting a short-circuit force requirement of the transformer is arranged in a circle of the cross-section of the core leg, the pulling plate 3 is isolated from the core piece by an insulating material, and then the pulling plate 3 is connected with the positioning holes of the upper frame and lower frame of the core by the connecting shaft 4, so that the upper frame, the lower frame and the pulling plate 3 are connected into a solid whole.

The pulling plate structure can meet the short-circuit force requirements of different transformers by changing cross-section sizes of the pulling plate 3 and the connecting shaft 4, the design scheme is simplified, and the manufacturing process is simple; since the pulling plate 3 is arranged in the circle of the cross-section of the core, an isolation distance among a winding, a lead and the pulling plate can be ignored, thus reducing an overall size of the transformer and saving a total cost of the transformer by 3% to 5%; and discharge points of the winding and the lead to ground are reduced, thus optimizing a structure, reducing costs, and improving a productivity and an operation safety of the transformer.

Certainly, the description above does not limit the disclosure, and the disclosure is not limited to the embodiments above. Any changes, modifications, additions or substitutions made by those skilled in the art within a substantial scope of the disclosure shall also fall within the protection scope of the disclosure.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A pulling plate structure for a three-dimensional wound core of a transformer, comprising:

a three-dimensional wound core spliced by three rectangular single frames, the three-dimensional wound core comprises three core legs, an upper iron yoke and a lower iron yoke;

an upper frame surrounding the upper iron yoke is installed in a top of the three-dimensional wound core;

a lower frame surrounding the upper iron yoke is installed in a bottom of the three-dimensional wound core, the core leg has a longitudinal cross-section opposite and parallel to inside faces of the upper frame and the lower frame; and a pulling plate installed in a plane of the longitudinal cross-section, and the pulling plate is connected with the upper frame and the lower frame;

wherein the pulling pate is isolated from the three-dimensional wound core.

2. The pulling plate structure of claim 1, wherein the upper frame and the lower frame are provided with positioning holes, and a connecting shaft for being fixedly connected with the pulling plate is installed in the positioning hole, and cross-section sizes of the pulling plate and the connecting shaft are adjustable.

3. The pulling plate of claim 1, wherein one of the three rectangular single frames is continuously wound by a plurality of silicon steel sheets.

4. The pulling plate structure of claim 1, wherein the upper frame and the lower frame comprise a chamfered triangular frame and a Y-shaped holder connected with an inside of the triangular frame.

5. The pulling plate structure of claim 1, wherein one of the three rectangular single frames is continuously wound by a plurality of amorphous alloy strips.

* * * * *